US005547476A

United States Patent [19]

Siklosi et al.

[11] Patent Number: 5,547,476

[45] Date of Patent: Aug. 20, 1996

[54] DRY CLEANING PROCESS

[75] Inventors: Michael P. Siklosi, Cincinnati; Timothy C. Roetker, Fairfield, both of Ohio

[73] Assignee: The Procter & Gamble Company, Cincinnati, Ohio

[21] Appl. No.: 544,360

[22] Filed: Oct. 17, 1995

Related U.S. Application Data

[63] Continuation-in-part of Ser. No. 414,156, Mar. 30, 1995, abandoned.

[51] Int. Cl.[6] ..... D06L 1/02; D06L 1/04

[52] U.S. Cl. ..... 8/142; 8/137; 510/291; 510/505; 510/506; 510/289; 510/321

[58] Field of Search ..... 8/137, 142; 252/8.6, 252/8.9, 90, 93, 162, 170, 173, 174.11, 91

[56] References Cited

U.S. PATENT DOCUMENTS

| | | | |
|---|---|---|---|
| 1,747,324 | 2/1930 | Savitt . | |
| 2,679,482 | 5/1954 | Ross | 252/531 |
| 2,769,172 | 9/1988 | Siklosi | 252/153 |
| 3,432,253 | 3/1969 | Dixon et al. | 8/142 |
| 3,591,510 | 7/1971 | Zenk | 252/137 |
| 3,593,544 | 7/1971 | Henderson . | |
| 3,647,354 | 3/1972 | Loeb | 8/158 |
| 3,705,113 | 12/1972 | Sharman | 252/555 |
| 3,737,387 | 6/1973 | Marple | 252/170 |
| 3,764,544 | 10/1973 | Haworth | 252/170 |
| 3,766,062 | 10/1973 | Wixon | 252/8.7 |
| 3,770,373 | 11/1973 | Schwartz | 8/142 |
| 3,882,038 | 5/1975 | Clayton et al. | 252/164 |
| 3,907,496 | 9/1975 | Néel et al. | 8/142 |
| 3,949,137 | 4/1976 | Akrongold . | |
| 3,956,198 | 5/1976 | BauerR | 252/542 |
| 3,956,556 | 5/1976 | McQueary | 428/131 |
| 4,007,300 | 2/1977 | McQueary | 427/242 |
| 4,063,961 | 12/1977 | Howard et al. | 134/4 |
| 4,097,397 | 6/1978 | Mizutani et al. | 252/153 |
| 4,102,824 | 7/1978 | Mizutani et al. | 252/545 |
| 4,115,061 | 9/1978 | Grünewälder | 8/137 |
| 4,126,563 | 11/1978 | Barker | 252/8.8 |
| 4,130,392 | 12/1978 | Diehl et al. | 8/101 |
| 4,139,475 | 2/1979 | Schwadtke et al. | 252/8.6 |
| 4,170,678 | 10/1979 | Urfer et al. | 428/124 |
| 4,188,447 | 2/1980 | Ehlenz . | |
| 4,219,333 | 8/1980 | Harris | 8/137 |
| 4,286,400 | 2/1994 | Paszek et al. | 252/88 |
| 4,336,024 | 6/1982 | Denissenko et al. | 8/142 |
| 4,395,261 | 7/1983 | Lutz | 8/111 |
| 4,396,521 | 8/1983 | Borrello | 252/118 |
| 4,493,781 | 1/1985 | Chapman et al. | 252/88 |
| 4,606,842 | 8/1986 | Keyes et al. | 252/174.23 |
| 4,659,494 | 4/1987 | Soldanski et al. | 252/88 |
| 4,659,496 | 4/1987 | Klemm et al. | 252/90 |
| 4,666,621 | 5/1987 | Clark et al. | 252/91 |
| 4,692,277 | 9/1987 | Siklosi | 252/558 |
| 4,758,641 | 7/1988 | Hsu | 526/208 |
| 4,797,310 | 1/1989 | Barby et al. | 428/71 |
| 4,802,997 | 2/1989 | Fox et al. | 252/8.6 |
| 4,806,254 | 2/1989 | Church | 252/8.6 |
| 4,834,900 | 5/1989 | Soldanski et al. | 252/88 |
| 4,847,089 | 7/1989 | Kramer et al. | 424/405 |

(List continued on next page.)

FOREIGN PATENT DOCUMENTS

| | | |
|---|---|---|
| 1005204 | 2/1977 | Canada . |
| 1295912 | 2/1992 | Canada . |
| 0213500 | 3/1987 | European Pat. Off. . |
| 0232530 | 8/1987 | European Pat. Off. . |
| 0261718 | 3/1988 | European Pat. Off. . |
| 261874 | 3/1988 | European Pat. Off. . |
| 286167 | 10/1988 | European Pat. Off. . |
| 0329209 | 8/1989 | European Pat. Off. . |
| 0334463 | 9/1989 | European Pat. Off. . |
| 0347110 | 12/1989 | European Pat. Off. . |
| 0429172A1 | 5/1991 | European Pat. Off. . |
| 491531 | 6/1992 | European Pat. Off. . |
| 503219 | 9/1992 | European Pat. Off. . |
| 0513948 | 11/1992 | European Pat. Off. . |
| 595383 | 5/1994 | European Pat. Off. . |
| 3904610 | 8/1990 | Germany . |
| 4129986 | 11/1993 | Germany . |
| 53-058095 | 5/1978 | Japan . |
| 61-014298 | 1/1986 | Japan . |

(List continued on next page.)

OTHER PUBLICATIONS

Hunt, D. G. and N. H. Morris, "PnB and DPnB Glycol Ethers", *HAPPI*, Apr. 1989, pp. 78–82.

Trautwein, K., J. Nassal, Ch. Kopp & L. Karle, "The Disinfectant Action of Glycols on Tuberculosis Organisms and their Practical Application", *Monatsh. Tierheilk*, vol. 7, Suppl. (1955) pp. 171–187. (Abstract only). (Month Unknown).

Ilg, H., & H. Fischer, "Synthesis and Application of Propoxylized Alcohols", *Text.–Prax.*, vol. 25, No. 8, (1970), pp. 484–487 (Abstract only). (Month Unknown).

Komarova, L. F., U. N. Garber & L. G. Chub, "Physical Properties of Monoethers of Mono– and Diglycols", *Zh. Obshch. Khim.*, vol. 40, No. 11 (1970), p. 2534, Russian (Abstract only). (Month Unknown).

Sokolowski, A. & J. Chlebicki, "The Effect of Polyoxypropylene Chain Length in Nonionic Surfactants on their Adsorption at the Aqueous Solution–Air Interface", *Tenside Deterg.*, vol. 19, No. 5 (1982), pp. 282–286 (Abstract only). (Month Unknown).

Hamlin, J. E., "Propylene Glycol Ethers and Esters in Solvent–Based Paint Systems", *Congr. FATIPEC*, 17th (4), (1984), pp. 107–122 (Abstract only). (Month Unknown).

(List continued on next page.)

*Primary Examiner*—Prince Willis Jr.
*Assistant Examiner*—Alan D. Diamond
*Attorney, Agent, or Firm*—Jerry J. Yetter; Jacobus C. Rasser

[57] ABSTRACT

A home dry cleaning process is provided. Thus, a carrier sheet releasably impregnated with solvents such as butoxy propoxy propanol, 1,2-octanediol as a wetting agent, water and an emulsifier is placed in a plastic bag with soiled garments and tumbled in a hot-air clothes dryer. The garments are cleaned and refreshed.

14 Claims, No Drawings

U.S. PATENT DOCUMENTS

| | | | |
|---|---|---|---|
| 4,849,257 | 7/1989 | Borch et al. | 427/242 |
| 4,882,917 | 11/1989 | Mizusawa et al. | 68/17 A |
| 4,886,615 | 12/1989 | Dehan | 252/90 |
| 4,909,962 | 3/1990 | Clark | 252/547 |
| 4,938,879 | 7/1990 | Kellett | 252/8.75 |
| 4,943,392 | 7/1990 | Hastedt et al. | 252/539 |
| 4,966,724 | 10/1990 | Culshaw et al. | 252/158 |
| 4,983,317 | 1/1991 | Requejo et al. | 252/174.24 |
| 5,004,557 | 4/1991 | Nagarajan et al. | 252/174.24 |
| 5,035,826 | 7/1991 | Durbut et al. | 252/121 |
| 5,041,230 | 8/1991 | Borcher et al. | 252/8.9 |
| 5,051,212 | 9/1991 | Culshaw et al. | 252/546 |
| 5,061,393 | 10/1991 | Linares et al. . | |
| 5,062,973 | 11/1991 | Kellett | 252/8.75 |
| 5,066,413 | 11/1991 | Kellett | 252/8.75 |
| 5,080,822 | 1/1992 | VanEenam | 252/170 |
| 5,102,573 | 4/1992 | Han et al. | 252/153 |
| 5,108,643 | 4/1992 | Loth et al. | 252/174.11 |
| 5,108,660 | 4/1992 | Michael | 252/545 |
| 5,112,358 | 5/1992 | Deal | 8/137 |
| 5,133,967 | 7/1992 | Smith | 424/401 |
| 5,145,523 | 9/1992 | Halpin | 106/287.24 |
| 5,173,200 | 12/1992 | Kellett | 252/8.8 |
| 5,202,045 | 4/1993 | Karpusiewicz et al. | 252/90 |
| 5,213,624 | 5/1993 | Williams | 134/40 |
| 5,232,632 | 8/1993 | Woo et al. | 252/546 |
| 5,236,710 | 8/1993 | Guerrero et al. | 424/401 |
| 5,238,587 | 8/1993 | Smith et al. | 252/8.6 |
| 5,304,334 | 4/1994 | Lahanas et al. | 252/314 |
| 5,322,689 | 6/1994 | Hughes et al. | 424/401 |
| 5,336,445 | 8/1994 | Michael et al. | 252/548 |
| 5,336,497 | 8/1994 | Guerrero et al. | 424/401 |
| 5,342,549 | 8/1994 | Michael | 252/546 |
| 5,344,643 | 9/1994 | Thiel et al. . | |
| 5,350,541 | 9/1994 | Michael et al. | 252/548 |
| 5,362,422 | 11/1994 | Masters | 252/544 |
| 5,380,528 | 1/1995 | Alban et al. | 424/401 |
| 5,415,812 | 5/1995 | Durbut et al. | 252/547 |

FOREIGN PATENT DOCUMENTS

| | | |
|---|---|---|
| 61-085498 | 5/1986 | Japan . |
| 62-252499 | 11/1987 | Japan . |
| 63-051500 | 3/1988 | Japan . |
| 02/206695 | 8/1990 | Japan . |
| 05/171566 | 7/1993 | Japan . |
| 06/049498 | 2/1994 | Japan . |
| 06/049497 | 2/1994 | Japan . |
| 06/146041 | 5/1994 | Japan . |
| 1397475 | 6/1975 | United Kingdom . |
| 1598911 | 9/1981 | United Kingdom . |
| WO91/09104 | 6/1991 | WIPO . |
| WO91/11505 | 8/1991 | WIPO . |
| WO91/13145 | 9/1991 | WIPO . |
| WO92/19713 | 11/1992 | WIPO . |
| WO93/04151 | 3/1993 | WIPO . |
| WO93/06204 | 4/1993 | WIPO . |
| WO93/25654 | 12/1993 | WIPO . |
| WO94/05766 | 3/1994 | WIPO . |
| WO94/09108 | 4/1994 | WIPO . |

OTHER PUBLICATIONS

DeFusco, A. J., "Coalescing Solvents for Architectural and Industrial Waterborne Coatings", *Proc. Water–Borne Higher–Solids Coat. Symp.*, 15th (1988), pp. 297–330 (Abstract only). (Month Unknown).

Vance, R. G., N. H. Morris & C. M. Olson, "Coupling Solvent Effects on Water–Reducible Alkyd Resins", *Proc. Water–Born Higher–Solids Coat. Symp.*, 16th (1989), pp. 269–282 (Abstract only). (Month Unknown).

Szymanowski, J., "The Estimation of Some Properties of Surface Active Agents", *Tenside, Surfactants, Deterg.*, vol. 27, No. 6 (1990), pp. 386–392 (Abstract only). (Month Unknown).

Spauwen, J., R. Ziegler & J. Zwinselman, "New Polypropylene Glycol–based Solvents for Aqueous Coating Systems", *Spec. Publ.–R. Soc. Chem.* 76 (Addit. Water–Based Coat.), (1990) (Abstract only). (Month Unknown).

Sokolowski, A., "Chemical Structure and Thermodynamics of Amphiphile Solutions. 2. Effective Length of Alkyl Chain in Oligooxyalkylenated Alcohols", *Colloids Surf.*, vol. 56 (1991), pp. 239–249 (Abstract only). (Month Unknown).

Asgharian, N., P. Otken, C. Sunwoo & W. H. Wade, "Synthesis and Performance of High–Efficiency Cosurfactants. 1. Model Systems", *Langmuir*, vol. 7, No. 12 (1991), pp. 2904–2910. (Abstract only). (Month Unknown).

DRY CLEANING PROCESS

This is a continuation-in-part of application Ser. No. 08/414,156, filed on Mar. 30, 1995, now abandoned.

FIELD OF THE INVENTION

The present invention relates to dry cleaning processes and compositions which are especially adapted for use in the home.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

While solvent-based dry cleaning processes are quite effective for removing oily soils and stains, they are not optimal for removing particulates such as clay soils, and may require special treatment conditions to remove proteinaceous stains. Ideally, particulates and proteinaceous stains are removed from fabrics using detersive ingredients and operating conditions which are more akin to aqueous laundering processes than to conventional dry cleaning.

In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape. Of course, such refreshment benefits are also afforded by aqueous laundering processes.

As can be seen from the foregoing, and aside from the effects on certain fabrics such as woolens, there are no special, inherent advantages for solvent-based immersion dry cleaning over aqueous cleaning processes with respect to fabric cleaning or refreshment. Moreover, on a per-garment basis, commercial dry cleaning is much more expensive than aqueous cleaning processes.

While it would be of considerable benefit to consumers to provide dry cleaning compositions and processes which can be used in the home, the typical solvent systems used in commercial dry cleaning render this impractical. Indeed, various in-home dry cleaning systems have been suggested, but have not been widely accepted.

It has now been determined that fabrics can be cleaned and refreshed by a process which employs a cleaning composition comprising unique combinations of ingredients such as butoxy propoxy propanol and 1,2-octanediol as the primary cleaning agents. Importantly, the present process can be carried out in a container device which does not require total immersion of the fabrics in the dry cleaning agent. Accordingly, the process herein can be conducted in the home.

BACKGROUND ART

Dry cleaning processes are disclosed in: EP 429,172A1, published 29.05.91, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. Nos. 3,956,556 and 4,007,300 relate to perforated sheets for fabric conditioning in a clothes dryer. U.S. Pat. No. 4,692,277 discloses the use of 1,2-octanediol in liquid cleaners.

SUMMARY OF THE INVENTION

The present invention encompasses a process for cleaning and refreshing fabrics, comprising contacting said fabrics with an effective amount of a cleaning composition, comprising:

(a) water;

(b) an etherified propanol solvent, especially "BPP" solvent, as disclosed hereinafter;

(c) 1,2-octanediol;

(d) an emulsifier, especially a polyacrylate emulsifier as disclosed hereinafter;

(e) optionally, a detersive surfactant; and (f) optionally, but preferably, a perfume.

The process herein is preferably conducted by placing said fabrics together with said cleaning composition in a container, such as a flexible bag, closing said container and agitating said container. In a convenient mode, the process is conducted by agitating the container in a tumbling apparatus, such as a hot air clothes dryer or a washing machine having a horizontally mounted rotatable drum. Heat is preferably employed during the agitation.

In a highly preferred mode, the process is conducted using the aforesaid cleaning composition, which is releasably contained and carried by or releasably affixed to an integral carrier, such as a lint-resistant pad or sheet. In one mode, the carrier is allowed to freely move and co-mingle with the fabrics being cleaned. In another mode, the carrier is affixed to an inner wall of the container.

A preferred and convenient process herein comprises the steps of:

(a) placing said fabrics to be cleaned and said cleaning composition as noted above within a container comprising a flexible plastic bag;

(b) closing and sealing said bag;

(c) placing said bag in a rotating apparatus; especially a hot air clothes dryer, and wherein the process is conducted at an air temperature within said dryer of at least about 50° C. (as noted, the process is preferably conducted using said cleaning composition releasably affixed to an integral carrier);

(d) rotating said bag for a period of at least about 10 minutes; and (e) removing said fabrics from the bag.

All percentages, ratios and proportions herein are by weight, unless otherwise specified. All documents cited are, in relevant part, incorporated herein by reference.

DETAILED DESCRIPTION OF THE INVENTION

The ingredients of the dry cleaning compositions and their use in the process of the present invention are described seriatim hereinafter.

Cleaning Compositions—The chemical compositions which are used to provide the cleaning function in the present dry cleaning process comprise ingredients which are safe and effective for their intended use. Since the process herein does not involve an aqueous rinse step, the cleaning compositions employ ingredients which do not leave undesirable residues on fabrics when employed in the manner disclosed herein. Moreover, since the process may be carried out in a hot air clothes dryer, the compositions contain only ingredients whose flash points render them safe for such use. The cleaning compositions preferably do contain some water, since water not only aids in the cleaning function, but also can help remove wrinkles and restore fabric drape and appearance, especially in hot air dryers. While conventional laundry detergents are typically formulated to provide good cleaning on cotton and cotton/polyester blend fabrics, the cleaning compositions herein must be formulated to safely and effectively clean and refresh fabrics such as wool, silk, rayon, rayon acetate, and the like.

In addition, the cleaning compositions herein comprise ingredients which are specially selected and formulated to minimize dye removal from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred cleaning compositions herein are formulated to minimize or avoid this problem.

The dye removal attributes of the present cleaning compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or nylon substrates) is treated by padding-on cleaner using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) I see a lot of dye on the towel"; through (4) "I know I see quite a lot of dye on the towel" are assigned by panelists.

Having due regard to the foregoing considerations, the following illustrates the ingredients used in the cleaning compositions herein, but is not intended to be limiting thereof.

(a) Water—The compositions will comprise at least about 60%, typically from about 80% to about 95%, by weight, of water. Stated otherwise, the objective is to provide at least about 6 g of water per kg of fabrics being cleaned.

(b) Solvent—The compositions will comprise at least about 4%, typically from about 5% to about 25%, by weight, of solvent. The objective is to provide at least about 0.4 g, preferably from about 0.5 g to about 2.5 g, of solvent per kg of fabrics being cleaned.

(c) 1,2-octanediol (OD)—The composition herein will comprise at least about 0.1%, preferably from about 0.5% to about 10%, by weight, of the OD. Stated otherwise, the objective is to provide from about 0.01 g to about 3 g of OD per kg of fabrics being cleaned.

(d) Emulsifier—The compositions will comprise sufficient emulsifier to provide a stable, homogeneous composition comprising components (a), (b) and (c). For the preferred emulsifiers disclosed hereinafter, levels as low as 0.05%, preferably 0.07% to about 0.20%, by weight, are quite satisfactory.

(d) Optionals—The compositions herein may comprise various optional ingredients, including perfumes, conventional surfactants, carriers and the like. If used, such optional ingredients will typically comprise from about 0.1% to about 10%, by weight, of the compositions, having due regard for residues on the cleaned fabrics.

The preferred solvent herein is butoxy propoxy propanol (BPP) which is available in commercial quantities as a mixture of isomers in about equal amounts. The isomers, and mixtures thereof, are all useful herein. The isomer structures are as follows:

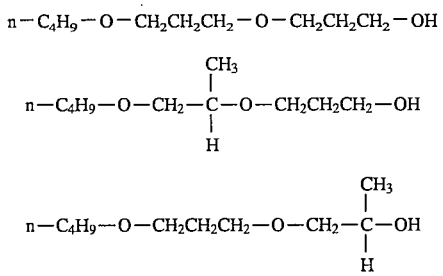

BPP is outstanding for cleaning, and is so effective that it allows the amount of the relatively expensive 1,2-octanediol to be minimized. Moreover, it allows for the formulation of effective cleaning compositions herein without the use of conventional surfactants. Importantly, the odor of BPP is of a degree and character that it can be relatively easily masked by conventional perfume ingredients. While BPP is not completely miscible with water and, hence, could negatively impact processing of the cleaning compositions herein, that potential problem has been successfully overcome by means of the PEMULEN-type polyacrylate emulsifiers, as disclosed hereinafter.

It has now been determined that 1,2-octanediol ("OD") affords special advantages in the formulation of the cleaning compositions herein. From the standpoint of aesthetics, OD is a relatively innocuous and low odor material. Moreover, OD appears to volatilize from fabric surfaces without leaving visible residues. This is especially important in a dry cleaning process of the present type which is conducted without a rinse step. From the performance standpoint, OD appears to function both as a solvent for greasy/oily stains and as what might be termed a "pseudo-surfactant" for particulate soils and water-soluble stains. Whatever the physical-chemical reason, OD has now been found to be a superior wetting agent with respect to both cleaning and ease-of-use in the present context of home-use cleaning compositions and processes.

The BPP solvent used herein is preferably a mixture of the aforesaid isomers. In a preferred mode, the cleaning compositions comprise a mixture of the 1,2-octanediol and BPP, at a weight ratio of OD:BPP in the range of from about 1:250 to about 2:1, preferably from about 1:200 to about 1:5.

The highly preferred emulsifier herein is commercially available under the trademark PEMULEN, The B. F. Goodrich Company, and is described in U.S. Pat. Nos. 4,758,641 and 5,004,557, incorporated herein by reference. PEMULEN polymeric emulsifiers are high molecular weight polyacrylic acid polymers. The structure of PEMULEN includes a small portion that is oil-loving (lipophilic) and a large water-loving (hydrophilic) portion. The structure allows PEMULEN to function as a primary oil-in-water emulsifier. The lipophilic portion adsorbs at the oil-water interface, and the hydrophilic portion swells in the water forming a network around the oil droplets to provide emulsion stability. An important advantage for the use of such polyacrylate emulsifiers herein is that cleaning compositions can be prepared which contain solvents or levels of solvents that are otherwise not soluble or readily miscible with water. A further advantage is that effective emulsification can be accomplished using PEMULEN-type emulsifier at extremely low usage levels (0.05–0.2%), thereby minimizing the level of any residue left on fabrics following product usage. For comparison, typically about 3–7% of conventional anionic or nonionic surfactants are required to stabilize oil-in-water emulsions, which increases the likelihood that a residue will be left on the fabrics. Another advantage is that emulsification (processing) can be accomplished effectively at room temperature.

While the cleaning compositions herein function quite well with only the 1,2-octanediol, BPP, PEMULEN and water, they may also optionally contain detersive surfactants to further enhance their cleaning performance. While a wide variety of detersive surfactants such as the $C_{12}$–$C_{16}$ alkyl sulfates and alkylbenzene sulfonates, the $C_{12}$–$C_{16}$ ethoxylated (EO 0.5–10 avg.) alcohols, the $C_{12}$–$C_{14}$ N-methyl glucamides, and the like can be used herein, it is highly preferred to use surfactants which provide high grease/oil removal. Included among such preferred surfactants are the $C_{12}$–$C_{16}$ alkyl ethoxy sulfates (AES), especially in their magnesium salt form, and the $C_{12}$–$C_{16}$ dimethyl amine oxides. An especially preferred mixture comprises $MgAE_1S$/$MgAE_{6.5}S$/$C_{12}$ dimethyl amine oxide, at a weight ratio of about 1:1:1. If used, such surfactants will typically comprise from about 0.05% to about 2.5%, by weight, of the cleaning compositions herein.

In addition to the preferred solvents and emulsifiers disclosed above, the cleaning compositions herein may comprise various optional ingredients, such as perfumes, preservatives, co-solvents, brighteners, salts for viscosity control, pH adjusters and buffers, anti-static agents, softeners, colorants, mothproofing agents, insect repellents, and the like.

Carrier—The foregoing cleaning compositions are not employed herein in loose form, since that could result in their uneven application to the surfaces of the fabrics being cleaned. Rather, the compositions are used in combination with a carrier, such that the cleaning composition performs its function as the surfaces of the fabrics being cleaned come in contact with the surface of the carrier.

The carrier can be in any desired form, such as powders, flakes, shreds, and the like. However, it will be appreciated that such comminuted carriers would have to be separated from the fabrics at the end of the cleaning process. Accordingly, it is highly preferred that the carrier be in the form of an integral pad or sheet which substantially maintains its structural integrity throughout the cleaning process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning composition or with the fabrics being cleaned. In general, non-woven polyester-based pads or sheets are quite suitable for use as the carrier herein.

The carrier used herein is most preferably lint-resistant. By "lint-resistant" herein is meant a carrier which resists the shedding of visible fibers or microfibers onto the fabrics being cleaned, i.e., the deposition of what is known in common parlance as "lint". A carrier can easily and adequately be judged for its acceptability with respect to lint-resistance by rubbing it on a piece of dark blue woolen cloth and visually inspecting the cloth for lint residues.

The lint-resistance of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, is not lint-resistant. The core is then enveloped within a sheet of porous, lint-resistant material having a pore size which allows passage of the cleaning compositions, but through which lint from the core cannot pass. An example of such a carrier comprises a cellulose or polyester fiber core enveloped in a non-woven polyester scrim.

The carrier should be of a size which provides sufficient surface area that effective contact between the surface of the carrier and the surface of the fabrics being cleaned is achieved. Of course, the size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a rectangular carrier may have the dimensions (x-direction) of from about 20 cm to about 35 cm, and (y-direction) of from about 18 cm to about 45 cm.

The carrier is intended to contain a sufficient amount of the cleaning composition to be effective for its intended purpose. The capacity of the carrier for the cleaning composition will vary according to the intended usage. For example, carrier/cleaning composition pads or sheets which are intended for a single use will require less capacity than such pads or sheets which are intended for multiple uses. For a given type of carrier the capacity for the cleaning composition will vary mainly with the thickness or "caliper" (z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning composition is effectively provided by means of the carrier.

Container—The present cleaning process is conducted using a flexible container. The fabrics to be cleaned are placed within the container with the carrier/cleaning composition article, and the container is agitated, thereby providing contact between the carrier/cleaning composition and the surfaces of the fabrics.

The flexible container used herein can be provided in any number of configurations, and is conveniently in the form of a flexible pouch, or "bag", which has sufficient volume to contain the fabrics being cleaned. Suitable containers can be manufactured from any economical material, such as polyester, polypropylene, and the like, with the proviso that it must not melt if used in contact with hot dryer air. It is preferred that the walls of the container be substantially impermeable to water vapor and solvent vapor under the intended usage conditions. It is also preferred that such containers be provided with a sealing means which is sufficiently stable to remain closed during the cleaning process. Simple tie strings or wires, various snap closures such as ZIP LOK® closures, and VELCRO®-type closures, contact adhesives, adhesive tape, zipper-type closures, and the like, suffice.

The container can be of any convenient size, and should be sufficiently large to allow tumbling of the container and fabrics therein, but should not be so large as to interfere with the operation of the tumbling apparatus. With special regard to containers intended for use in hot air clothes dryers, the container must not be so large as to block the air vents. If desired, the container may be small enough to handle only a single shirt, blouse or sweater, or be sufficiently large to handle a man's suit.

Process—The present cleaning process can be conducted in any manner which provides mechanical agitation, such as a tumbling action, to the container with the fabrics being cleaned. If desired, the agitation may be provided manually. However, in a convenient mode a container with the carrier/cleaning composition and enveloping the soiled fabric is sealed and placed in the drum of an automatic clothes dryer. The drum is allowed to revolve, which imparts a tumbling action to the container and agitation of its contents concurrently with the tumbling. By virtue of this agitation, the fabrics come in contact with the carrier containing the cleaning composition. It is preferred that heat be employed during the process. Of course, heat can easily be provided in a clothes dryer. The tumbling and optional (but preferred) heating is carried out for a period of at least about 10 minutes, typically from about 20 minutes to about 30 minutes. The process can be conducted for longer or shorter periods, depending on such factors as the degree and type of soiling of the fabrics, the nature of the soils, the nature of the fabrics, the fabric load, the amount of heat applied, and the like, according to the needs of the user. The following illustrates a typical process in more detail, but is not intended to be limiting thereof.

EXAMPLE I

A dry cleaning article in sheet form is assembled using a sheet substrate and a cleaning composition prepared by admixing the following ingredients.

| Ingredient | % (wt.) |
|---|---|
| BPP* | 7.0 |
| 1,2-octanediol | 0.5 |
| PEMULEN TR-1** | 0.15 |
| KOH | 0.08 |
| Perfume | 0.75 |
| Water | Balance |

*Isomer mixture, available from Dow Chemical Co.
**PEMULEN TR-2, B. F. Goodrich, may be substituted.

A non-linting carrier sheet is prepared using a non-woven, two-ply fabric stock comprising polyester fibers, caliper 0.25 mm to 0.34 mm, basis weight 84 g/m$^2$. The fabric is cut into square carrier sheets, approximately 25 cm on a side, i.e., 625 cm$^2$ sheets. Three or four rows of regularly-spaced 1.27 cm (0.5 in.) diameter circular holes are punched through the sheet. (The finished sheet can later be folded for packaging, and when unfolded and used in the manner disclosed herein, the holes help maintain the sheet in the desired unfolded configuration.)

23 Grams of the above-noted cleaning composition are evenly applied to the sheet by spreading onto the sheet with a roller or spatula using hand pressure. In an alternate mode, the cleaning composition can be applied by dipping or spraying the composition onto the substrate, followed by squeezing with a roller or pair of nip rollers, i.e., by "dip-squeezing" or "spray squeezing". The external surfaces of the sheet are damp but not tacky to the touch.

A dry cleaning sheet of the foregoing type is unfolded and placed flat in a plastic bag having a volume of about 25,000 cm$^3$ together with 2 kg of dry garments to be cleaned. The bag is closed, sealed and placed in a conventional hot-air clothes dryer. When the garments and the dry cleaning sheet are placed in the bag, the air is preferably not squeezed out of the bag before closing and sealing. This allows the bag to billow, thereby providing sufficient space for the fabrics and cleaning sheet to tumble freely together. The dryer is started and the bag is tumbled for a period of 20–30 minutes at a dryer air temperature in the range from about 50° C. to about 85° C. During this time, the dry cleaning sheet remains substantially in the desired open position, thereby providing effective contact with the fabrics. After the machine cycle is complete, the bag and its contents are removed from the dryer, and the spent dry cleaning sheet is discarded. The plastic bag is retained for re-use. The garments are cleaned and refreshed. The water present in the cleaning composition serves to minimize wrinkles in the fabrics.

In an alternate mode, heavily soiled areas of the fabric being cleaned can optionally be pre-treated by pressing or rubbing a fresh dry cleaning sheet according to this invention on the area. The sheet and pre-treated fabric are then placed in the container, and the dry cleaning process is conducted in the manner described herein.

Having thus described and exemplified the present invention, the following further illustrates various cleaning compositions which can be formulated and used in the practice thereof.

EXAMPLE II

| Ingredient | % (wt.) Formula Range |
|---|---|
| BPP* | 5–25% |
| 1,2-Octanediol | 0.1–7% |
| $MgAE_1S$ | 0.01–0.8% |
| $MgAE_{6.5}S$ | 0.01–0.8% |
| $C_{12}$ Dimethyl Amine Oxide | 0.01–0.8% |
| PEMULEN** | 0.05–0.20% |
| Perfume | 0.01–1.5% |
| Water | Balance |
| pH Range about 6 to about 8. | |

*Other organic solvents or co-solvents which can be used herein include various glycol ethers, including materials marketed under trademarks such as Carbitol, methyl Carbitol, butyl Carbitol, propyl Carbitol, and hexyl Cellosolve, methoxy propoxy propanol (MPP), ethoxy propoxy propanol (EPP), propoxy propoxy propanol (PPP), and all isomers and mixtures, respectively, of MPP, EPP, and PPP, and the like, and mixtures thereof. If desired, and having due regard for safety for in-home use, v arious conventional chlorinated and hydrocarbon dry cleaning solvents may also be used. Included among these are 1,2-dichloroethane, trichlorethylene, isoparaffins, and mixtures thereof. Although somewaht less preferred than BPP, the MPP, EPP and PPP etherified propanol solvents can be substituted in equivalent proportions for the BPP in the exemplified cleanign compositions for use in the present process. Weight ratios of these latter solvents with the 1,2-octanediol are in the same range as disclosed for the preferred BPP solvent.
**As disclosed in U.S. Pat. Nos. 4,758,641 and 5,004,557, such polyacrylates include homopolymers which may be crosslinked to varying degrees, as well as non-crosslinked. Preferred herein are hompolymers having a molecualr weight in the range of from about 100,000 to about 10,000,000, preferably 200,000 to 5,000,000.

Excellent cleaning performance is secured using any of the foregoing non-immersion processes to provide an effective amount, i.e., typically from about 5 g to about 50 g of the cleaning compositions per kilogram of fabrics being cleaned.

EXAMPLE III

A dry cleaning composition with reduced tendency to cause dye "bleeding" or removal from fabrics as disclosed above is as follows.

| INGREDIENT | PERCENT (wt.) | (RANGE) |
|---|---|---|
| Butoxypropoxy propanol (BPP) | 7.000 | 4.0–25.0% |
| NEODOL 23 - 6.5* | 0.750 | 0.05–2.5% |
| 1,2-Octanediol | 0.500 | 0.1–10.0% |
| Perfume | 0.750 | 0.1–2.0% |
| Permulen TR-1 | 0.125 | 0.05–0.2% |
| Potassium Hydroxide (KOH) | 0.060 | 0.024–0.10 |
| Potassium Chloride | 0.075 | 0.02–0.20 |
| Water (distilled or deionized) | 90.740 | 60.0–95.0% |
| Targen pH = 7.0 | | |

*Shelll; $C_{12}$–$C_{13}$ alcohol, ethoxylated with average EO of 6.5.

15–25 Grams of a composition of the foregoing type are placed on a carrier sheet for use in the manner disclosed herein. A preferred carrier substrate comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | gm/m$^2$ | 55 | 35–75 |
| Thickness | microns | 355 | 100–1500 |
| Density | g/mcc | 0.155 | 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | gm/cm$^2$ | 1050 | 700–1200 |

*MD - machind direction; CD - cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning compositions herein, but actually optimizes cleaning performance. While not intending to be limited by theory, it may be speculated that this carrier is more effective in delivering the cleaning composition to soiled fabrics. Or, this particular carrier might be better for removing soils by contact with the soiled fabrics, due to its mixture of fibers. Whatever the reason, improved dry cleaning performance is secured.

In addition to the improved cleaning performance, it has now been discovered that this hydroentangled carrier material provides an additional, unexpected benefit due to its resiliency. In-use, the dry cleaning sheets herein are designed to function in a substantially open configuration. However, the sheets are packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used, if desired). Accordingly, this newly-discovered and unexpected attribute of the carrier materials herein makes them optimal for use in the manner of the present invention.

A sheet of the foregoing type is placed together with the fabrics to be dry cleaned in a flexible containment bag having dimensions as noted hereinabove and sealing means. The bag can be closed and sealed for use by any convenient re-usable means, including nylon zippers, Velcro®-type closures, nylon Zip-Lok®-type closures, and the like. In a preferred mode, the containment bag is constructed of thermal resistant film in order to provide resistance to hot spots (350° F.–400° F.; 177° C. to 204° C.) which can develop in some dryers. This avoids internal self-sealing and external surface deformation of the bag, thereby allowing the bag to be re-used.

In a preferred embodiment, 0.0025 mm to 0.0075 mm thickness nylon film is convened into a 26 inch (66 cm)×30 in. (76 cm) bag. Bag manufacture can be accomplished in a conventional manner using standard impulse heating equipment, air blowing techniques, and the like. In an alternate mode, a sheet of nylon is simply folded in half and sealed along two of its edges.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C.).

Besides the optional nonionic surfactants used as component (g) of the cleaning compositions used in the process herein, which are preferably $C_8$–$C_{18}$ ethoxylated (E01-15) alcohols or the corresponding ethoxylated alkyl phenols, the compositions used herein can contain enzymes to further enhance cleaning performance. Lipases, amylases and protease enzymes, or mixtures thereof, can be used. If used, such enzymes will typically comprise from about 0.001% to about 5%, preferably from about 0.01% to about 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

If an antistatic benefit is desired, the compositions used herein can contain an anti-static agent, as optional component (h). If used, such anti-static agents will typically comprise at least about 0.5%, typically from about 2% to about 8%, by weight, of the compositions. Preferred anti-stats include the series of sulfonated polymers available as VERSAFLEX 157, 207, 1001, 2004 and 7000, from National Starch and Chemical Company.

The compositions herein can optionally be stabilized for storage using conventional preservatives such as KATHON® at a level of 0.001%–1%, by weight.

If the compositions herein are used in a spot-cleaning mode, they are preferably pressed (not rubbed) onto the fabric at the spotted area using an applicator pad comprising looped fibers, such as is available as APLIX 200 or 960 Uncut Loop, from Aplix, Inc., Charlotte, N.C. An underlying absorbent sheet or pad of looped fibers can optionally be placed beneath the fabric in this mode of operation.

What is claimed is:

1. A cleaning and refreshing process for fabrics, comprising agitating said fabrics with an effective amount of a cleaning composition, so that the fabrics are cleaned and refreshed, wherein said composition comprises:

(a) water;

(b) an etherified propanol solvent;

(c) 1,2-octanediol;

(d) an emulsifier;

(e) optionally, a detersive surfactant;

(f) optionally, a perfume; and (g) optionally, a nonionic surfactant.

2. A process according to claim 1 which is conducted by placing said fabrics together with said cleaning composition in a container, closing said container and agitating said container.

3. A process according to claim 2 wherein the container is a flexible bag.

4. A process according to claim 2 wherein the container is agitated by means of a hot air clothes dryer or a washing machine having a horizontally mounted rotatable drum.

5. A process according to claim 1 wherein said cleaning composition is releasably contained by or releasably affixed to an integral carrier.

6. A process according to claim 5 wherein the carrier is a lint-resistant pad or sheet.

7. A process according to claim 5 wherein said carrier is allowed to freely move with the fabrics being cleaned.

8. A process according to claim 2 wherein the cleaning composition is releasably contained by or releasably affixed to an integral carrier and the carrier is affixed to an inner wall of the container.

9. A process according to claim 1, comprising the steps of:

(a) placing said fabrics to be cleaned and said cleaning composition within a container comprising a flexible plastic bag;

(b) closing and sealing said bag;

(c) placing said bag in a rotating apparatus;

(d) rotating said bag for a period of at least about 10 minutes; and (e) removing said fabrics from the bag.

10. A process according to claim 9 wherein the rotating apparatus is a hot air clothes dryer, and wherein the process is conducted at an air temperature within said dryer of at least about 50° C.

11. A process according to claim 10 wherein said cleaning composition is releasably affixed to an integral carrier.

12. A process according to claim 1 wherein the etherified propanol solvent is a member selected from the group consisting of the monomethyl-, monoethyl-, monopropyl-, and monobutylethers of propoxypropanol, and mixtures thereof.

13. A process according to claim 1 wherein the solvent is butoxy propoxy propanol.

14. A process according to claim 1 wherein the nonionic surfactant is an ethoxylated alcohol.

* * * * *